United States Patent [19]

McNutt et al.

[11] Patent Number: 4,757,996

[45] Date of Patent: Jul. 19, 1988

[54] PADDLE BALL GAME

[75] Inventors: Paul B. McNutt, R.R. 1, Box 380 #417, Wailuku, Hi. 96793; Gilbert Belmudez, Lahania, Hi.; Keith Roseman, Philadelphia; John L. Giungo, Dresher, both of Pa.

[73] Assignee: Paul B. McNutt, Huntington Beach, Calif.

[21] Appl. No.: 42,895

[22] Filed: Apr. 27, 1987

Related U.S. Application Data

[63] Continuation-in-part of Ser. No. 856,290, Apr. 28, 1986, abandoned.

[51] Int. Cl.[4] ..... A63B 59/00

[52] U.S. Cl. ..... 273/67 R; 273/411

[58] Field of Search ..... 273/67 R, 75, 76, 64, 273/67 A, 67 B, 67 C, 67 D; 15/235.4

[56] References Cited

U.S. PATENT DOCUMENTS

| | | | |
|---|---|---|---|
| 454,700 | 6/1891 | Barker | 273/67 B |
| 1,177,116 | 3/1916 | Lackland | 273/67 R |
| 3,765,042 | 10/1973 | Montrella | 441/58 |
| 3,817,520 | 6/1974 | Burgus | 273/67 R X |
| 4,253,673 | 3/1981 | Bailey | 273/411 X |
| 4,516,774 | 5/1985 | Nankivell | 273/67 B |

FOREIGN PATENT DOCUMENTS

| | | | |
|---|---|---|---|
| 909812 | 9/1972 | Canada | 273/67 R |
| 2135048 | 2/1973 | Fed. Rep. of Germany | 273/67 R |
| 599727 | 3/1948 | United Kingdom | 273/411 |

OTHER PUBLICATIONS

Physical Education Handbook, Sixth Edition, Prentice-Hall, UC © 1974 and Earlier Years, Received Feb. 6, 1975, pp. 381–389.

*Primary Examiner*—William H. Grieb

*Attorney, Agent, or Firm*—William H. Eilberg

[57] ABSTRACT

A two-handed paddle ball game, and a paddle for playing the game, are disclosed. The game is normally played by two players, standing in spaced-apart courts. The courts are defined by stretching a cord around a set of pegs. The players hold paddles in both hands, and may strike the ball with either paddle. The serving player scores a point by causing the ball to hit the ground within the opposing player's court, or by causing the ball to hit the ground outside the opposing court after the opposing player has touched the ball. Only the server can score a point; when the non-serving player hits the ball onto the ground within the server's court, the serve is awarded to the non-serving player. The invention also includes a paddle for playing the game. The paddle has a handle, into which the user's hand is inserted. The paddle can be rapidly rotated during play, and can therefore be turned to strike a ball which may arrive from virtually any direction. In one embodiment, the handles of the paddles are shaped to conform to the user's hand, and to provide resting surfaces for the thumb and forefingers.

13 Claims, 4 Drawing Sheets

PADDLE BALL GAME

CROSS-REFERENCE TO PRIOR APPLICATION

This is a continuation-in-part of U.S. Patent Application Ser. No. 856,290, filed Apr. 28, 1986, now abandoned.

BACKGROUND OF THE INVENTION

The present invention relates to the field of paddle ball games, and includes an apparatus and method for playing a new game of this type. The invention also includes a novel construction of the paddle.

The prior art is filled with patents for paddle ball games, and other games involving players in opposing courts. For example, U.S. Pat. No. 4,457,513 discloses a paddle ball game in which a ball is tossed back and forth by two players, and including a rebound structure at the center of the court. U.S. Pat. No. 4,497,492 discloses another game in which a ball is tossed between two opposing players.

Some devices of the prior art have the primary object of providing a miniaturized version of a familiar game. One example is shown in U.S. Pat. No. 3,968,968, which describes a small volleyball court, for use by two sitting or kneeling players. Another example is given in U.S. Pat. No. 4,523,762, which shows a ball game wherein a tethered ball is tossed back and forth by two players. Other court structures for playing paddle ball games are shown in U.S. Pat. Nos. 3,926,433 and 4,194,740.

Various types of paddles, for use in paddle ball games, have also been described in the prior art. Paddles have been designed with various types of handles for attachment to a player's hand. Examples of such paddles are shown in U.S. Pat. Nos. 4,387,895, 4,516,774, 2,987,316, and 1,402,799.

The present invention includes a game apparatus, and a method for playing the game, providing a competitive, recreational, and healthful activity. The game apparatus occupies very little storage space, and weighs very little, and therefore is quite portable. Unlike the paddle ball games known in the past, the game is played with a paddle in both hands, and the paddle is designed so that it can be rapidly pivoted to enable the player to strike a ball arriving from virtually any direction. While the game is primarily intended to be played by two persons, the apparatus can be used by more than two, and can even be used by one person.

The invention also includes a unique construction for the paddle, wherein the handle of the paddle is shaped to conform to the contour of the player's hand, and wherein the paddle also includes surfaces on which the player's thumb and forefinger can rest.

SUMMARY OF THE INVENTION

The equipment used in playing the game of the present invention includes paddles, a ball, two boundary cords, and a set of pegs around which the cords are strung. In its preferred form, the game is played by two players. There are four paddles, two for each player, and eight pegs. The pegs are driven into the ground to define two generally rectangular courts, the courts preferably being separated from each other by a certain distance. The players bounce the ball from one court to the other, accumulating points according to a set of rules.

In the preferred form of the game, when the serving player causes the ball to hit the ground within the court of the other player, the serving player receives a point. The server also receives a point if the ball hits the ground outside the opposing player's court, where the opposing player touches the ball before it reaches the ground. Only the server can score a point. If the non-serving player causes the ball to hit the ground within the server's court, or if the server touches the ball in an unsuccessful attempt to return the volley, the non-serving player receives the right to serve. The play continues until one of the players accumulates a fixed number of points. The game rules can also require that the game be won by a minimum of a certain margin, such as two points or more.

The invention also includes a paddle which is particularly suited for use in the above-described game. In one embodiment, the paddle comprises a generally flat member attached to a handle. The flat member includes a curved indentation, approximating the curvature of a player's wrist. The handle permits the player's fingers to be inserted through it. By moving the fingers, in a motion similar to the opening or closing of a fist, the orientation of the flat member can be rapidly changed. The paddle can thus be pivoted almost instantly, enabling the player to prepare to return a served ball arriving from any given direction.

In another embodiment, the handle of the paddle is shaped to conform to the contour of the player's hand. The handle is attached to a finger support which is also affixed to the paddle. The finger support provides a surface around which the player's thumb can be wrapped during play. It also provides a surface on which the player's forefinger can rest. The handle itself is bulb-shaped, with its thickest portion located at or near its midpoint. In the latter embodiment, the handle is positioned such that the axis of the handle is generally parallel to the major axis, i.e. the longest dimension, of the paddle surface. The paddle made according to this embodiment enables a player to play the game with greater efficiency, and with less fatigue.

It is therefore an object of the invention to provide a paddle ball game, wherein the players use two paddles each.

It is another object of the invention to provide a game as described above, wherein the paddles can be rapidly turned or pivoted to return a ball arriving from virtually any direction.

It is another object of the invention to provide apparatus for playing a paddle ball game, wherein the apparatus occupies very little space, and which is relatively light in weight and portable.

It is another object of the invention to provide a paddle, suitable for use in playing a two-handed paddle ball game.

It is another object to provide a paddle as described above, wherein the paddle has a handle and support which are shaped to conform to the shapes of the hand and fingers of the player, and which provide support for the flat surface of the paddle.

It is another object to provide a paddle as described above, wherein the handle and support also help to orient the paddle in the desired manner.

It is another object of the invention to facilitate the playing of paddle ball games, by providing a paddle which is light in weight, and which minimizes fatigue of the player.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
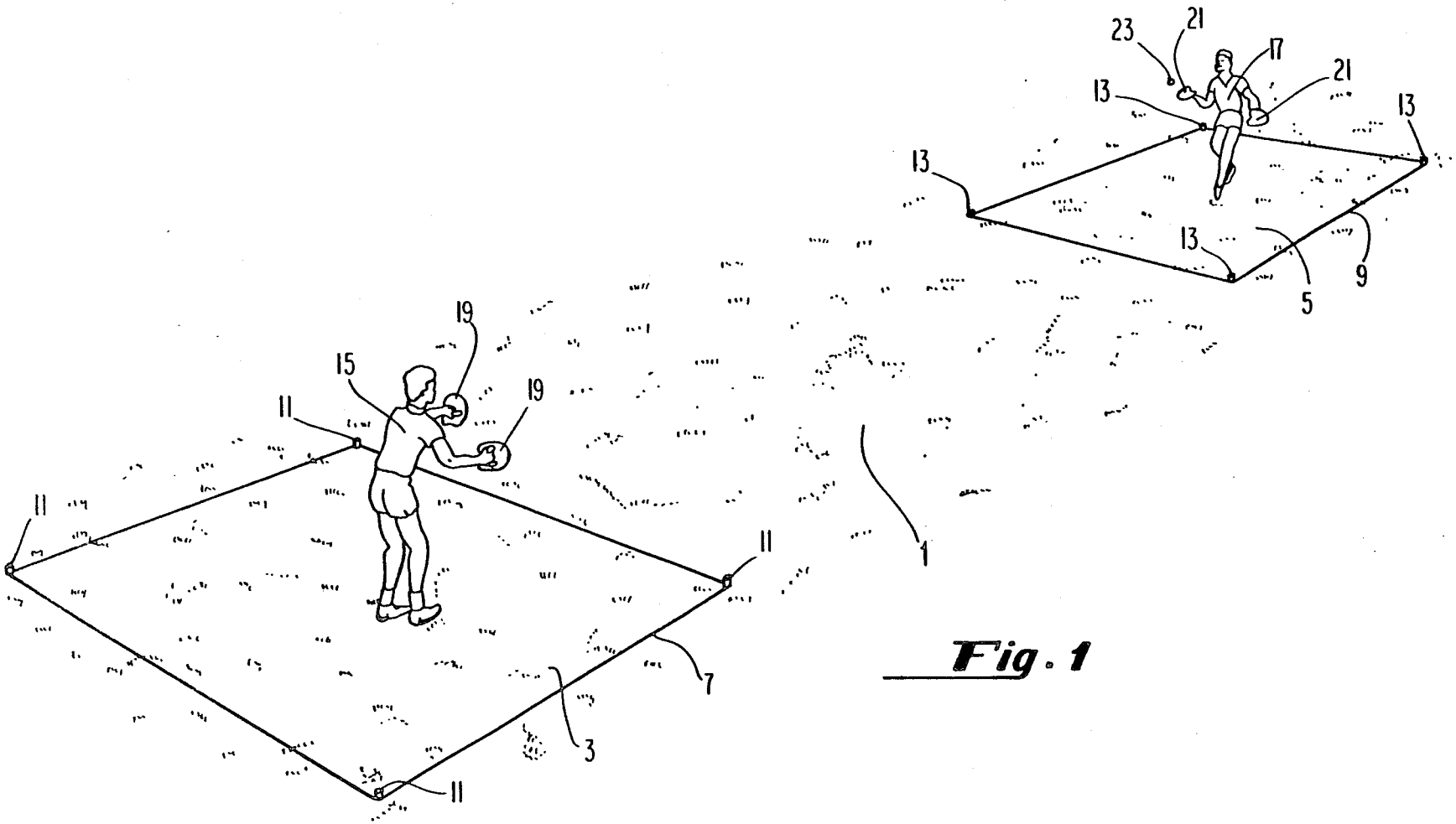
FIG. 1 is a perspective view, illustrating the game of the present invention, as it is played by two players, the players holding paddles in both hands.

FIG. 1 illustrates the equipment used in playing the paddle ball game of the present invention. The game is played on ground 1, on which two courts 3 and 5 are defined. Court 3 is formed by boundary cord 7, which is strung around pegs 11. The cord can be formed of thin or medium gauge nylon rope, or other equivalent material. The pegs can be made of plastic or aluminum, or equivalent material, and can be of U-shaped construction. Court 5 is formed by boundary cord 9, which is strung around pegs 13. Players 15 and 17 stand within their respective courts. Player 15 has a pair of paddles 19, one in each hand, and player 17 similarly has paddles 21. In FIG. 1, player 17 is about to strike ball 23 with one of the paddles 21.

Figure 2:
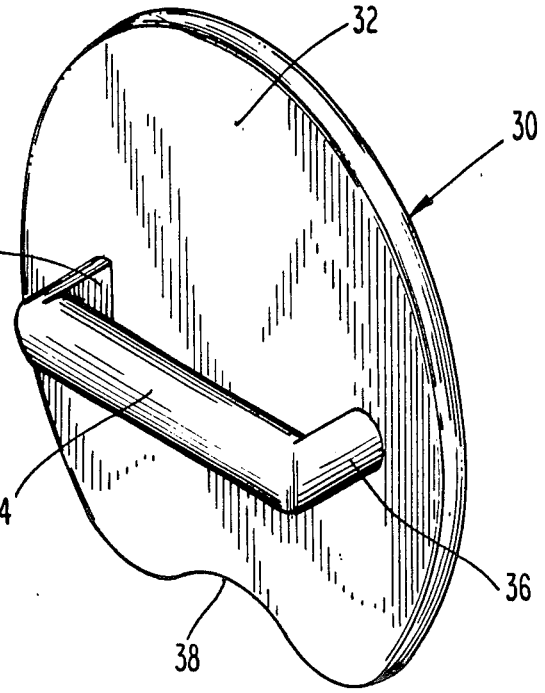
FIG. 2 is a perspective view of a first embodiment of a paddle constructed according to the invention.
Figure 3:
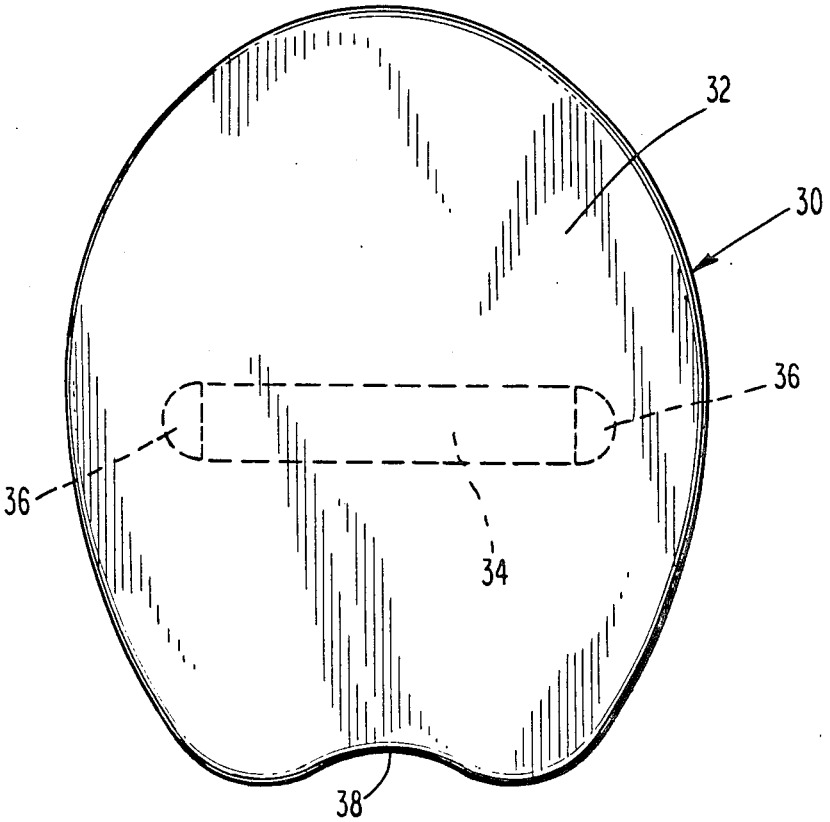
FIG. 3 is plan view of the playing surface of the paddle of FIG. 2, indicating the position of the handle, on the non-playing surface, in dotted outline.

The structure of one embodiment of the paddles is shown in detail in FIGS. 2 and 3. Paddle 30 includes a generally flat member 32 and a handle defined by support members 36 and cross member 34. The flat member 32 is constructed with a curved indentation 38, which conforms generally to the curvature of a player's wrist.

The height and width of the support members 36 should be sufficient to allow all the fingers of a player to be inserted into the handle. When the fingers are opened and closed, in a motion similar to that of opening and closing a fist, the flat member 32 rapidly pivots, changing its orientation with the slightest movement of the player's hand. When the fingers are in their fully "closed" position, i.e. when the players fingers are curved, as if to make a fist, the indentation 38 will tend to rest on the inside of the player's wrist, preventing further rotation of the paddle. When the fingers are in their fully open position, i.e. when the player's hand and fingers are generally straight, the flat member 32 will rest along the back of the player's hand and the outside of the player's wrist.

The paddle should be constructed so that the flat member is slightly larger than the opened hand. The flat member can thus be about 6.5 inches wide, and 7.75 long, but these dimensions are only suggested, and can be varied. Also, the handle can be about 4.5 inches wide, and the cross member can be about 0.625 inches from the flat member, allowing the fingers of the player's hand to be inserted into the handle. These dimensions are also only exemplary, and can be varied.

The paddle can be constructed of a solid piece of plastic, or can be made of wood, with a separate wooden or plastic handle attached by fasteners. It is preferred that the ball used in the present invention be a small rubber ball, about 0.75 inches in diameter, but other dimensions are also possible.

An alternative embodiment of the paddle is shown in FIGS. 4, 5, 6, 7, and 8. Paddle 50 includes flat member 52, having curved indentation 54. Paddle 50 includes handle 56 and finger support 58. The handle and finger support can be integrally-formed with the flat member, or they can be separately formed and then attached thereto.

Handle 56 is of generally bulbous construction, and has narrow portions 60 and 62, and wide portion 64. The handle is generally streamlined, so that the width of the handle changes continuously from point to point. The handle is spaced apart from the flat member, along at least a part of the length of the handle, so that the player can wrap fingers around the handle. The bulbous shaped reduces unnecessary use of muscles during play.

Handle 56 also has a plurality of holes 66. These holes facilitate the formation of the paddle from one piece of molded plastic. They also reduce the weight of the paddle, enhancing it maneuverability during play. Also, the holes enable air to flow more freely around the player's hand during a game. The weight of the paddle can be further reduced through the use of foam molding.

Finger support 58 has a wide portion 68 and a narrow portion 70. Like the handle, the finger support is streamlined, and changes its width continuously between portions 68 and 70. As shown in the figures, the contour of the handle is smoothly curved into the contour of the finger support, and vice versa. The narrow portion 62 of handle 56 flares out, increasing in width before joining the finger support. Perferably, both elements are considered part of a unitary, smoothly curved piece.

The round edge 72 of the finger support is intended to support the player's thumb. The surface 74 is a resting surface for the player's forefinger. The player may, however, retract the forefinger, and wrap it around narrow portion 62 of handle 56.

The surface 74 also helps to keep the paddle in the desired orientation. Because of the relative positions of the handle and the finger support, there is essentially only one way to grasp the paddle. The handle and finger support virtually assure that the paddle will be oriented properly for maximum efficiency during play.

The finger support and handle also improve the means by which the flat surface of the paddle is supported. The player's thumb and forefinger, and narrow portion 60 of the handle, together comprise a three-point support for the paddle surface. This three-point arrangement maximizes the usable area of that surface. Moreover, when the forefinger is extended on the finger support, torsion of the paddle surface is also minimized.

Finger support 58 has ribs 76, which, like the holes 66, facilitate the molding of the paddle. The ribs also reduce the weight and improve the air flow around the paddle, thereby slowing moisture formation on the player's hand. The ribs thus add to the comfort of the paddle, and improve its grip.

Figure 4:
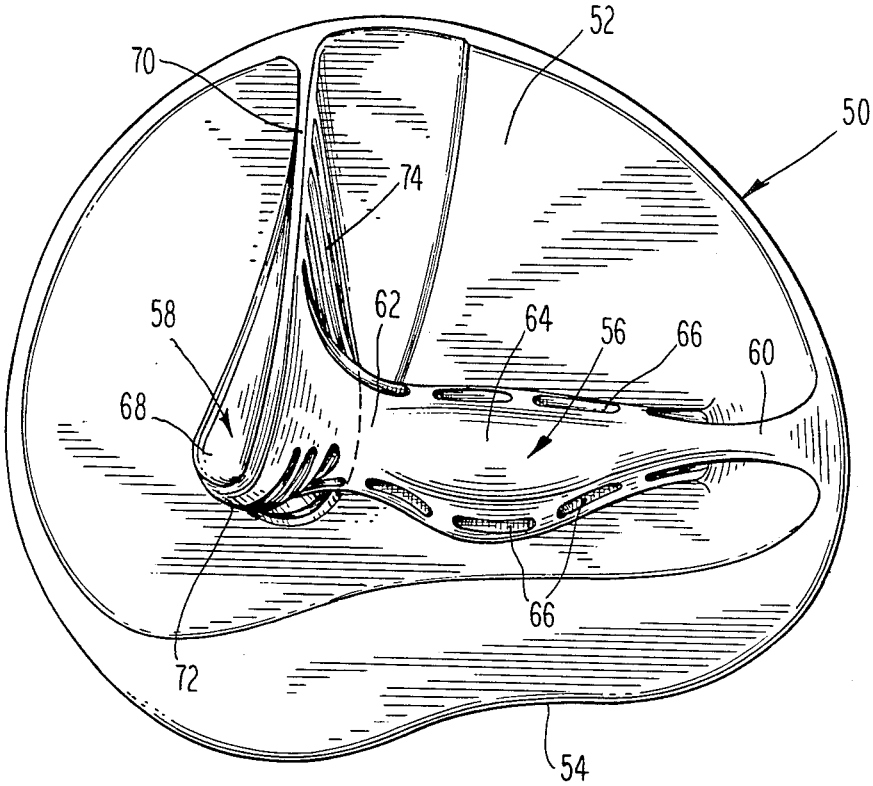
FIG. 4 is a top plan view of a second embodiment of a paddle, constructed according to the present invention.
Figure 5:
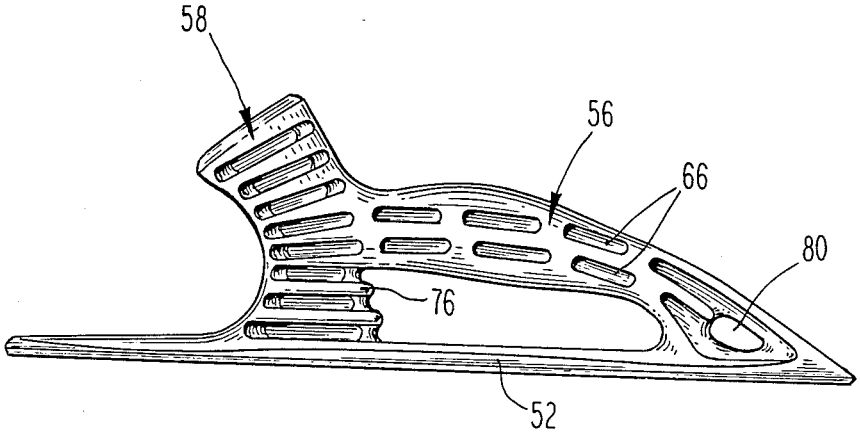
FIG. 5 is a front elevational view of the paddle of FIG. 4.
Figure 6:
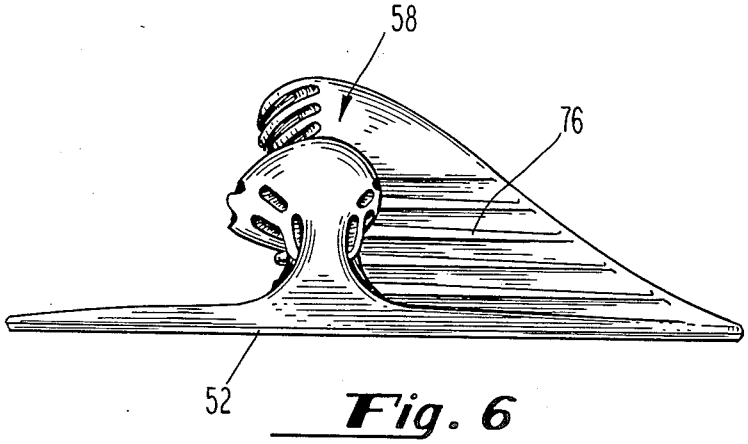
FIG. 6 is a side elevational view of the paddle, as seen from the right-hand side of FIG. 4.
Figure 7:
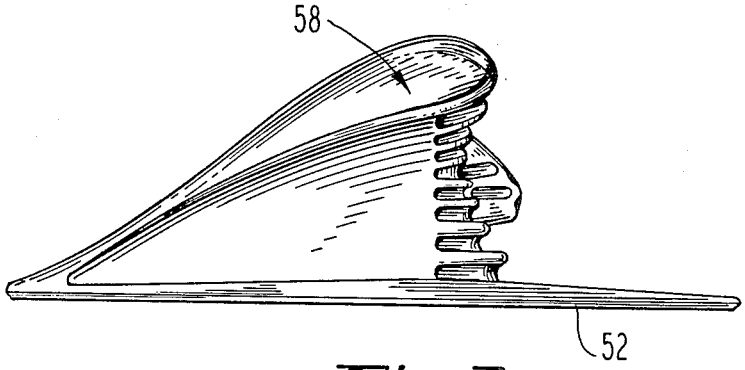
FIG. 7 is a side elevational view of the paddle, as seen from the left-hand side of FIG. 4.
Figure 8:
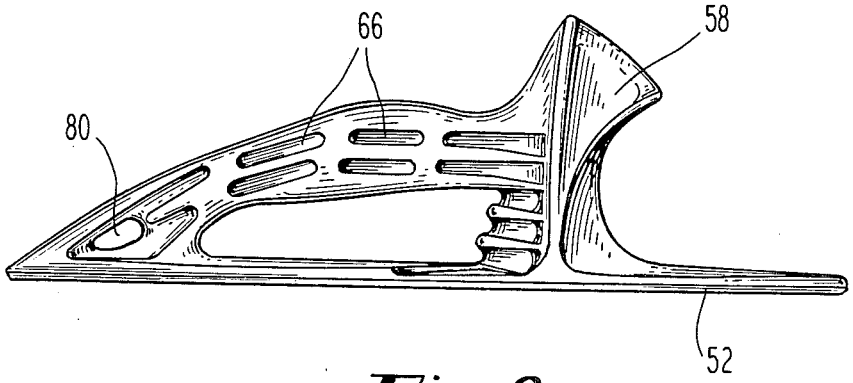
FIG. 8 is a rear elevational view of the paddle of FIG. 4.

As shown in both FIGS. 3 and 4, the flat member of the paddle is not symmetric, but instead has a long dimension and a short dimension, i.e. major and minor axes. In the embodiment of FIGS. 4–8, the axis of the handle is generally parallel to the major axis of the flat member. This feature is the opposite of the construction of FIGS. 2 and 3, which show a handle perpendicular to the major axis. It has been found that the orientation used in the embodiment of FIGS. 4–8 enables the player to use the paddle with maximum efficiency, because the paddle is normally held so that the handle portion is generally vertical. With such orientation, the major axis of the paddle surface is also vertical, thus maximizing the area of the paddle which is most likely to be used in hitting a ball.

As in the first embodiment, the indendation 54 facilitates the pivoting of the paddle onto the player's wrist. Also, as in the first embodiment, the paddle can be very quickly rotated when the player's fingers are extended into a straight position.

Hole 80 can be formed in handle 56. The hole can be used to attach a strap, which can be fastened around the player's hand, to prevent the paddle from slipping out during play. The strap can also be used to eliminate the need to put the paddle down, when the game is briefly stopped. The strap could also be used to hang the paddle.

The paddle shown in FIGS. 4–8 can be controlled precisely during play, with maximum comfort, and without causing fatigue to the user. Previous paddle constructions required that the paddle be gripped tightly. With the paddle shown in FIGS. 4–8, a tight grip is normally not necessary, due to the support of the paddle by the thumb and forefinger. With a looser grip, the amount of fatigue is reduced.

Also, in the embodiment of FIGS. 4–8, the hand assumes a very natural position in grasping this paddle, so there is little or no strain on the player. When the hand assumes the position wherein the forefinger is extended, the paddle handle naturally fits the contour of the hand created by this position.

The following is a description of the game, and its rules, in its preferred form. It is understood, however, that variations of these rules are possible. It is also understood that the game can be played with either of the paddles described above.

First, the players define their courts. It is recommended that the courts be rectangular, with a width of twelve feet and a depth of ten feet. The distance between the courts should be about twenty feet. It is important that the courts be aligned with each other, so that their side boundaries lie along the same lines. It is, of course, possible to play the game with other dimensions for the courts and their spacing; the numbers given herein are only suggestions, and should not be considered critical.

The courts are created by driving the pegs into the ground, as shown in FIG. 1, and stringing cords around the pegs to define the rectangular court. It is helpful to mark the cord beforehand, at four points, to indicate the desired position for each peg.

It is preferred that the game be played on grass, or a similar soft surface, so that the pegs can be easily inserted so as to define the courts. But it is also possible to play the game on a hard surface, as long as there is an alternative means of forming the boundaries. For example, a set of heavy but movable posts can be used to support the cord. It is even possible to play on a hard, indoor surface which has been painted with markings to define the courts. It is understood that any means of defining the courts, whether permanent or temporary, is within the scope of this invention.

A player may position himself anywhere within the court, although the center is normally the best overall position. The player is not restricted to the boundaries of the court, and may step over those boundaries when necessary. The boundaries are instead used to determine the awarding of points, as described below.

Only the serving player can score a point. When the serving player causes the ball to hit the ground within the opponent's court, the server receives a point. If the serving player causes the ball to hit the ground outside of the opponent's court, but the opponent has touched the ball before it reaches the ground, then the server also receives a point. But if the serving player hits the ball onto the ground outside the opponent's court, and the opposing player has not touched the ball, then the server loses the serve. The term "touching" the ball, as used herein, refers to any kind of contact between a paddle and the ball, or between the player's body and the ball, while the ball is in that player's court on a particular volley.

When the non-serving player hits the ball onto the ground within the server's court, that player does not receive a point, but instead wins the next serve. The non-serving player also receives the serve by hitting the ball onto the ground outside the server's court, if the server has touched the ball. If the non-serving player hits the ball onto the ground outside the server's court, and the server does not touch the ball, the serving player receives a point.

At the beginning of the game, the serve is awarded by an initial volley. One of the players tosses the ball, and the volley is not considered "legal" until the ball has been hit three times consecutively. After three such hits, the firts player to score, i.e. to cause the ball to hit the ground within the opponent's court, or to hit the ground anywhere after being touched by the opponent, wins the serve.

To serve the ball, the serving player must display the ball by throwing it, slightly, into the air. The server then serves the ball by using an underhand motion to strike the ball. The trajectory of the ball must reach a height of not less than six feet, and not more than ten feet. If these requirements are not met, the server simply serves again. There is no penalty for an improper serve. Of course, the definition of a legal serve can be varied, especially if the distance between the courts, and the size of the courts, are changed.

The first player to score fifteen points is the winner. The game must be won by a minimum margin of two points, so the game must be played into "overtime" if necessary. The game can, of course, be varied to be played for different numbers of points, and other required winning margins can be used.

While the game has been described as a game for two players, it can also be played by four persons, in the style of a doubles tennis match. In the latter case, it is recommended that the size of the court be increased to $20 \times 15$ feet.

The apparatus described above can also be used for noncompetitive play. The players can simply attempt to maintain a volley as long as possible, without keeping a record of points scored. It is also possible to play a speed game, which provides excellent aerobic exercise. A speed game is played best by hitting the ball sharply at about the waist level. A good distance between the players is 20–25 feet. The faster the ball is returned, the more thorough the exercise.

An individual player can use the paddle described herein to bounce the ball against a wall. The aim is to keep the ball in motion as long as possible, using a variety of methods of striking the ball, and using both hands.

The paddles described are extremely versatile, and can be used for playing many other, conventional games such as ping-pong, hand ball, racquetball, tennis, and volleyball. Also, they can be used in a two-paddle game, or they can be used singly.

The objects of the invention have been fulfilled by the above disclosure. As stated above, there are many variations which can be made in the game. The means for defining the boundaries of the courts can be changed. The exact method of scoring the game, and the number of points required to win the game, can be varied. Different kinds of balls, or other projectiles, can be used. The shape of the courts can be varied; it is not essential that the courts be rectangular.

One can also vary the construction of the paddles, within the scope of the invention. The holes, for example, could be omitted. Variations in the exact contour of the handle and finger support, in FIGS. 4–8, could be made. These and other similar modifications should be deemed within the spirit and scope of the following claims.

What is claimed is:

1. A paddle for a paddle ball game, comprising:
(a) a generally flat member, the flat member being sufficiently rigid for striking a ball, the flat member including a curved indentation, the curved indentation being shaped generally to conform to the shaped of the wrist of a player,
(b) a handle, attached to the flat member, the handle being of a generally bulbous shape, the handle being spaced apart from the flat member along at least a portion of the length of the handle, and
(c) a generally curved finger support, the finger support being connected to the handle and to the flat member, the finger support including a curved surface shaped to receive the player's thumb, the finger support also including a surface upon which the player's forefinger can rest.

2. The paddle of claim 1, wherein the handle has a plurality of holes formed therein.

3. The paddle of claim 1, wherein the finger support has a plurality of ribs formed therein.

4. The paddle of claim 1, wherein the handle has a hole which is capable of receiving a strap.

5. A paddle for a paddle ball game, comprising a generally flat member, the flat member being attached to a handle, the handle being curved, the handle having at least one wide portion and at least two portions narrower than the wide portion, the narrow portions being disposed on either side of the wide portion, the handle being spaced apart from the flat member along at least a portion of the length of the handle, further comprising a finger support, the finger support being connected to one end of the handle, and also being connected to the flat member, the finger support including a curved surface for receiving the thumb of a user, the finger support also including a surface for supporting the forefinger of the user.

6. The paddle of claim 5, wherein the handle includes a plurality of holes.

7. The paddle of claim 5, wherein the finger support includes a plurality of ribs.

8. The paddle of claim 5, wherein the contour of the handle is smoothly curved into the contour of the finger support.

9. A paddle for a paddle ball game, comprising a generally flat member, the flat member being attached to a handle, the handle being curved, the handle having at least one wide portion and at least two portions narrower than the wide portion, the narrow portions being disposed on either side of the wide portion, the handle being spaced apart from the flat member along at least a portion of the length of the handle, further comprisng a finger support, the finger support being connected to the flat member, the finger support including a curved surface for receiving the thumb of a user.

10. A paddle for a paddle ball game, comprising a generally flat member, the flat member being attached to a handle, the handle being curved, the handle having at least one wide portion and at least two portions narrower than the wide portion, the narrow portions being disposed on either side of the wide portion, the handle being spaced apart from the flat member along at least a portion of the length of the handle, furher comprising a finger support, the finger support being connected to the flat member, the finger support including a curved surface for supporting the forefinger of the user.

11. A paddle for a paddle ball game, comprising a generally flat member, the flat member being attached to a handle, the handle being curved, the handle having at least one wide portion and at least two portions narrower than the wide portion, the narrow portions being disposed on either side of the wide portion, the handle being spaced apart from the flat member along at least a portion of the length of the handle, further comprising a finger support, the finger support being connected to the handle, the finger support including a curved surface.

12. A paddle for a paddle ball game, comprising a generally flat member, the flat member being attached to a handle, the handle being curved, the paddle including a finger support, the finger support being connected to the flat member, the finger support including a curved surface for receiving a finger of a user.

13. A paddle for a paddle ball game, comprising a generally flat member, the flat member being attached to a handle, the handle being curved, the paddle also comprising a finger support, the finger support being connected to one end of the handle, and also being connected to the flat member, the finger support including a curved surface for receiving the thumb of a user, the finger support also including a surface for supporting the forefinger of the user.

* * * * *